US008920211B2

(12) United States Patent
Wakazono et al.

(10) Patent No.: US 8,920,211 B2
(45) Date of Patent: Dec. 30, 2014

(54) TRUING DEVICE OF GRINDING MACHINE

(75) Inventors: Yoshio Wakazono, Nagoya (JP); Tetsuro Furuhata, Nagoya (JP); Hisanobu Kobayashi, Toyokawa (JP)

(73) Assignee: JTEKT Corporation, Osaka-shi (JP)

( * ) Notice: Subject to any disclaimer, the term of this patent is extended or adjusted under 35 U.S.C. 154(b) by 295 days.

(21) Appl. No.: 13/492,009

(22) Filed: Jun. 8, 2012

(65) Prior Publication Data

US 2012/0329368 A1 Dec. 27, 2012

(30) Foreign Application Priority Data

Jun. 27, 2011 (JP) ..... 2011-141580
Nov. 18, 2011 (JP) ..... 2011-252296

(51) Int. Cl.
*B24B 49/18* (2006.01)

(52) U.S. Cl.
USPC ..... 451/21; 451/9; 451/10; 451/11; 451/443

(58) Field of Classification Search
USPC ..... 451/8, 9, 10, 11, 12, 21, 22, 56, 443
See application file for complete search history.

(56) References Cited

U.S. PATENT DOCUMENTS 4,051,830 A * 10/1977 Gruber ..... 125/11.01
4,122,635 A * 10/1978 Asano et al. ..... 451/5
4,897,967 A * 2/1990 Maruyama et al. ..... 451/5
5,006,685 A * 4/1991 Hatano et al. ..... 219/69.2
5,139,005 A * 8/1992 Dodd ..... 125/11.01
5,681,209 A * 10/1997 Naumann et al. ..... 451/51
5,738,569 A * 4/1998 Mackowsky ..... 451/56
6,290,574 B1 * 9/2001 Thyssen ..... 451/9
6,884,151 B2 * 4/2005 Sakai et al. ..... 451/8
2002/0081944 A1 * 6/2002 Sakai et al. ..... 451/8
2004/0219866 A1 * 11/2004 Sakai et al. ..... 451/21

FOREIGN PATENT DOCUMENTS

JP 6-3561 1/1994
JP 6-210565 8/1994

OTHER PUBLICATIONS

P. Schregenberger, et al. "CNC-gesteuertes, fehlerkompensiertes abrichtgeraet zum profilieren von schleifscheiben", Werkstatt und Betrieb, vol. 126, No. 8, XP-000385130, Aug. 1, 1993, pp. S58, S61-S62.

* cited by examiner

*Primary Examiner* — Eileen P. Morgan
(74) *Attorney, Agent, or Firm* — Oblon, Spivak, McClelland, Maier & Neustadt, L.L.P.

(57) ABSTRACT

A truing device of a grinding machine includes: a truer that corrects a shape of a grinding wheel; a swivel table that supports the truer such that the truer is swivelable about a swivel axis Ac; detecting means for directly detecting a distance from a truing edge position of the truer, which contacts the grinding wheel during correction of the shape of the grinding wheel, to a swivel center O of the swivel table; and control means for controlling the truing edge position of the truer with respect to the grinding wheel based on the distance L detected by the detecting means to true the grinding wheel.

14 Claims, 8 Drawing Sheets

TRUING DEVICE OF GRINDING MACHINE

INCORPORATION BY REFERENCE/RELATED APPLICATION

This application claims priority to Japanese Patent Applications No. 2011-141580 filed on Jun. 27, 2011 and 2011-252296 filed on Nov. 18, 2011 the disclosure of which, including the specification, drawings and abstract, is incorporated herein by reference in its entirety.

BACKGROUND OF THE INVENTION

1. Field of the Invention

The invention relates to a truing device that includes a truer that corrects the shape of a grinding wheel in a grinding machine that grinds a workpiece with the use of the grinding wheel.

2. Discussion of Background

Some grinding machines are provided with a truing device that corrects the shape of the grinding surface of a grinding wheel in order to machine a workpiece into a predetermined shape or in order to maintain appropriate grinding efficiency. For example, Japanese Patent Application Publication No. 6-210565 (JP 6-210565 A) describes a swiveling truing device as the above-described truing device. The swiveling truing device swivels a rotatable rotary truer about an axis perpendicular to a central axis of a grinding wheel to carry out truing of the grinding wheel. In the swiveling truing device, the truing edge position of the truer (the truing edge position of the outer peripheral surface when viewed from the radial direction, in the case of a rotary truer) may be deviated from a control position used in truing due to an installation error of a support member for the truer, abrasion of the truer itself, or the like.

In a truing device of a grinding machine, the influence of the above-described positional deviation of the truer needs to be reduced in order to improve the accuracy of truing. Therefore, JP 6-210565 A describes a method of detecting the position of the outer peripheral surface of the grinding wheel with the use of a contact sensor before and after truing, and making a correction based on the detected positions to carry out subsequent truing. More specifically, JP 6-210565 A describes a method of calculating the outside diameter of the grinding wheel on the basis of the values detected by the contact sensor and then calculating the amount of abrasion of the truer on the basis of the outside diameter of the grinding wheel. According to this method, at the time of the subsequent truing, the operation of a grinding wheel head that is synchronized with the swiveling operation of the truer is corrected on the basis of the amount of abrasion of the truer. Therefore, the positional deviation of the truer is reduced to carry out truing with higher accuracy. In addition, Japanese Utility Model Application Publication No. 6-3561 (JP 6-3561 U) describes a truing device that is provided with contact sensors (electric micrometers) that contact a truer to detect the truing edge position of the truer. With this truing device, the movement amount of the truer is corrected on the basis of electric signals from the contact sensors to correct a positional deviation of the truer.

However, in the method described in JP 6-210565 A, the amount of abrasion of the truer is indirectly calculated on the basis of the outside diameter of the grinding wheel. Therefore, deviation factors, such as a rotation runout of the grinding wheel and a thermal displacement of a grinding machine, may influence the detection by the contact sensor. Furthermore, in the truing device, the position of the outer peripheral surface of the grinding wheel at the time of detection by the contact sensor differs from the position of the outer peripheral surface of the grinding wheel that is positioned at the time of actual truing. Therefore, an error may be contained in the calculated amount of abrasion of the truer.

In addition, in the swiveling truing device, the influence of a positional deviation of the truer is particularly large when the sectional shape of the grinding wheel at the outer peripheral surface is formed into a curved surface shape, such as an arc shape. Therefore, it is necessary to detect the truing edge position of the truer using the swivel center as the reference position, and to correct the positional deviation of the truer more appropriately. The truing device described in JP 6-3561 U detects the truing edge position of the truer with the use of the contact sensors. Even if this configuration is applied to a swiveling truing device, the reference position does not coincide with the swivel center. Therefore, it is necessary to indirectly calculate the truing edge position of the truer with respect to the swivel center. Accordingly, the above-described deviation factors may influence detection by the contact sensors.

SUMMARY OF THE INVENTION

The invention provides a truing device of a grinding machine, which is able to carry out truing with higher accuracy.

According to a feature of an example of the invention, a truing device controls a distance from a truing edge position of a truer to a swivel center of a swivel table on the basis of a distance directly detected by detecting means to carry out truing. Thus, it is possible to more reliably detect a positional deviation of the truer without influence of deviation factors, such as the rotation runout of a grinding wheel and the thermal displacement of a grinding machine. Therefore, the truing edge position of the truer relative to the grinding wheel is controlled taking into account the positional deviation of the truer detected by the control unit. Accordingly, it is possible to correct the positional deviation and amount of abrasion of the truer. Thus, the truing device is able to carry out truing with higher accuracy. Therefore, even when the sectional shape of the grinding wheel at the outer peripheral surface is a complex shape, such as a curved surface shape, it is possible to suppress the influence of the shape and carry out truing with high accuracy.

According to another feature of an example of the invention, the detecting means is supported by the swivel table. Thus, when the position of the detecting means is adjusted relative to the truer, which is a detection target, by the swivel table, it is possible to perform detection taking into account the influence of the operation of the swivel table that is controlled in truing. Therefore, it is possible to more accurately detect the distance.

According to a further feature of an example of the invention, the detecting means is supported so as to be movable in a direction along a swivel axis of the swivel table.

According to another feature of the invention, by way of example, the truing device includes a movable body that is provided on the swivel table and that supports the truer such that the truer is movable in a radial direction of the swivel table.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
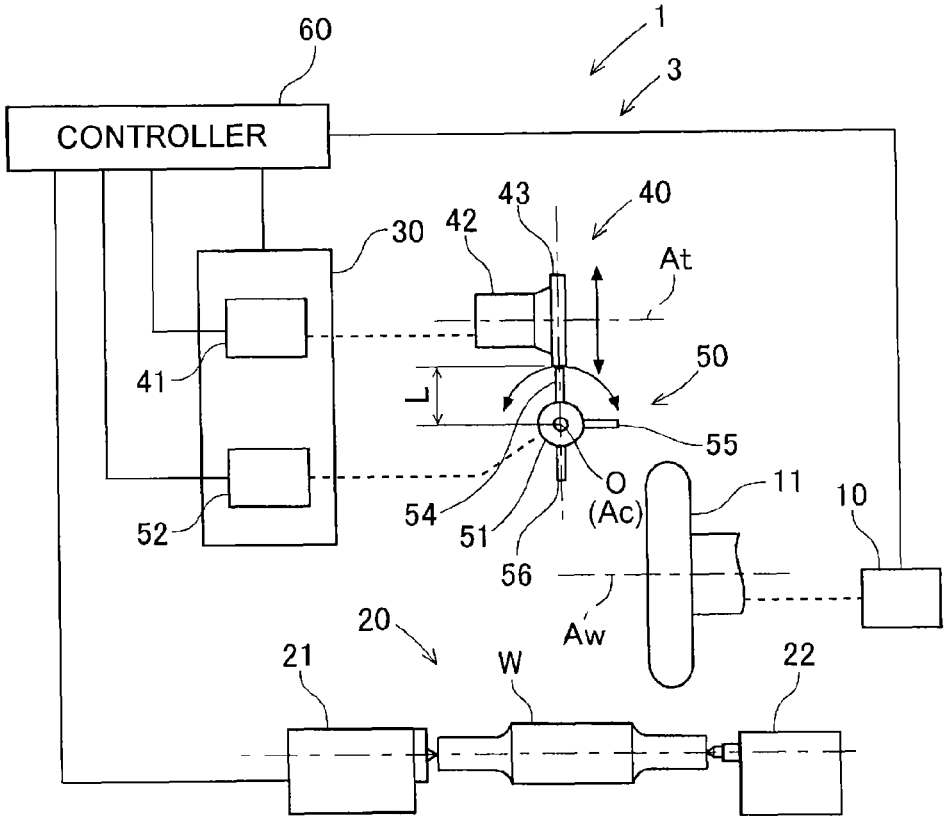
FIG. 1 is a block diagram that shows a grinding machine and a truing device according to a first embodiment of the invention.

Hereinafter, embodiments of the invention will be described with reference to the accompanying drawings.

A first embodiment of the invention will be described below. First, the configuration of a truing device of a grinding machine will be described. A grinding machine 1 according to the first embodiment of the invention will be described with reference to FIG. 1 to FIG. 3. The grinding machine 1 is a machine tool that moves a grinding wheel 11 relative to a workpiece W supported on a bed 2 to grind the workpiece W. The grinding machine 1 includes a truing device 3, a grinding wheel head 10, a workpiece support device 20 and a controller 60 (which may function as "control means" according to the invention). The truing device 3 of the grinding machine 1 corrects the shape of the grinding surface of the grinding wheel 11 for the purpose of machining the workpiece W into a predetermined shape. In the present embodiment, the truing device 3 is a swiveling truing device that swivels a truer about an axis Ac perpendicular to the central axis Aw of the grinding wheel 11 to true the grinding wheel 11.

The grinding wheel head 10 has the grinding wheel 11 that grinds the workpiece W. The grinding wheel head 10 is arranged on guide rails (not shown) that are arranged on the upper face of the bed 2 and that extend in the direction along the central axis Aw of the grinding wheel 11. In addition, the grinding wheel head 10 has an actuating mechanism. The actuating mechanism moves the grinding wheel 11 in the direction that is perpendicular to the direction in which the guide rails extend and that is parallel to the upper face of the bed 2. The grinding wheel 11 is supported by the grinding wheel head 10 via the actuating mechanism. Thus, the grinding wheel 11 is movable in the axial direction and radial direction of the workpiece W. In addition, for example, movement in each axial direction and rotational speed of the grinding wheel 11 of the grinding wheel head 10 are controlled by the controller 60.

The grinding wheel 11 is formed, for example, by bonding hard abrasive grains to the outer periphery of a disc-shaped metal core. In the present embodiment, the workpiece W is illustrated as a stepped shaft member in which portions having different outside diameters are aligned in the axial direction. Furthermore, the workpiece W has portions in a concave arc shape at corners between the outer periphery of the large-diameter portion and the outer peripheries of the small-diameter portions. In order to grind the thus formed workpiece W, the sectional shape of the grinding wheel 11 at the outer peripheral surface is formed (rounded off) into a convex arc shape corresponding to the concave arc shape of the workpiece W. That is, both axial ends of the cylindrical grinding outer surface of the grinding wheel 11 are formed into a convex curved surface shape.

The workpiece support device 20 supports both ends of the workpiece W such that the workpiece W is rotatable about the central axis of the workpiece W. The workpiece support device 20 includes a headstock 21 and a tailstock 22. The headstock 21 supports one end of the workpiece W. The tailstock 22 is arranged to face the headstock 21, and supports the other end of the workpiece W. The headstock 21 includes a spindle that is rotated by a rotary driving device (not shown). The workpiece W rotates as the spindle is rotated. In addition, for example, the rotational speed and rotation phase of the spindle of the headstock 21 are controlled by the controller 60.

Figure 2:
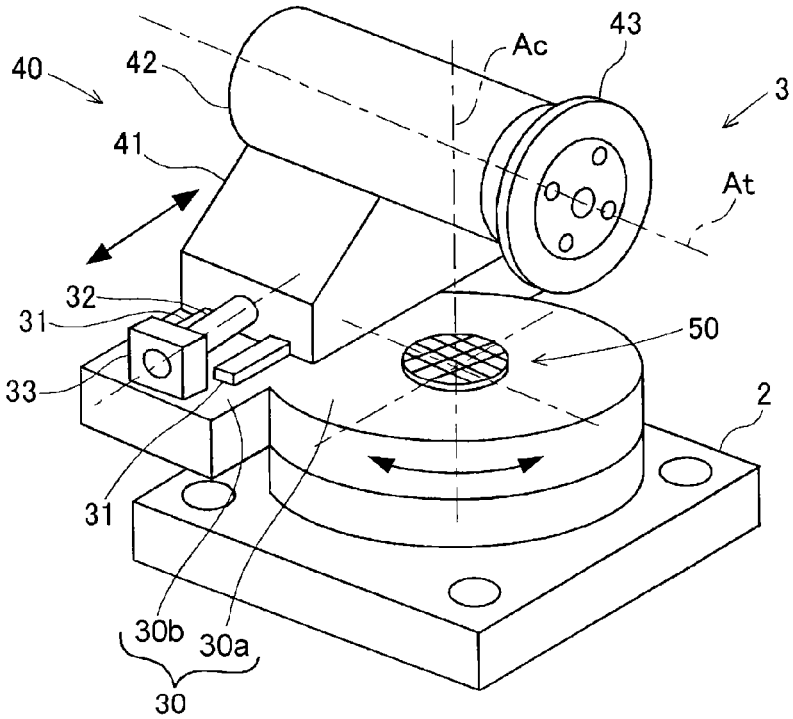
FIG. 2 is a perspective view of the truing device of the grinding machine according to the first embodiment.

The swiveling truing device 3 trues the outer peripheral surface of the grinding wheel 11. As shown in FIG. 1 and FIG. 2, the swiveling truing device 3 includes a swivel table 30, a truer head 40 and a sensor unit 50 (which may function as "detecting means" according to the invention). The swivel table 30 is arranged on the upper face of the bed 2, and is swiveled about a swivel axis Ac by a swivel driving device (not shown). The swivel table 30 has two truer head guide rails 31, a truer head linear movement axis ball screw 32 and a truer head linear movement axis motor 33. In addition, as shown in FIG. 2, the upper face of the swivel table 30 is formed of a circular portion 30*a* and a rectangular portion 30*b*. The swivel table 30 swivels about the swivel axis Ac that passes through the center O of the circular portion 30*a*.

The two truer head guide rails 31 are arranged in parallel with each other so as to extend in the longitudinal direction of the rectangular portion 30*b* of the swivel table 30. The truer head linear movement axis ball screw 32 is arranged between the two truer head guide rails 31 so as to drive the truer head 40 in the longitudinal direction of the rectangular portion 30*b* of the swivel table 30. The truer head linear movement axis motor 33 is a motor that rotates the truer head linear movement axis ball screw 32, and is arranged at one end of the truer head linear movement axis ball screw 32. In addition, the swivel driving device and truer head linear movement axis motor 33 of the swivel table 30 are controlled by the controller 60. Thus, the swivel speed of the swivel table 30 relative to the bed 2 is controlled, and, for example, the rotational speed and rotation phase of the truer head linear movement axis ball screw 32 are controlled.

The truer head 40 has a base 41 (which may function as "movable body" according to the invention), a truer driving mechanism 42 and a rotary truer 43 (which may function as "truer" according to the invention). The base 41 is provided on the rectangular portion 30*b* of the swivel table 30 so as to be slidable over the truer head guide rails 31 in the longitudinal direction of the rectangular portion 30*b* (direction from the lower left side to the upper right side in FIG. 2). The base 41 is coupled to a nut portion of the truer head linear movement axis ball screw 32, and is fed along the truer head guide rails 31 as the truer head linear movement axis motor 33 is driven.

The truer driving mechanism 42 is secured onto the upper portion of the base 41, and rotates a truer shaft with the use of a built-in motor (not shown). The rotary truer 43 is a truing tool that corrects the shape of the grinding wheel 11, and is fitted at an end portion of the truer shaft of the truer driving mechanism 42. Thus, the rotary truer 43 is rotated about the central axis At as the truer driving mechanism 42 is rotated. In the present embodiment, the rotary truer 43 is formed into a disc shape, and the outer peripheral surface of the rotary truer 43 is made of, for example, diamond. The outer peripheral surface of the rotary truer 43 has a cylindrical shape. The rotary truer 43 is formed such that its axial width is smaller than the axial width of the grinding wheel 11.

In addition, the rotary truer 43 is disposed such that a plane that is perpendicular to the central axis At of the rotary truer 43 and that passes through the center portion of the axial width of the rotary truer 43 contains the swivel axis Ac of the swivel table 30. That is, when the swivel table 30 is swiveled about the swivel axis Ac, the distance between the outer peripheral surface of the rotary truer 43 and the swivel center O of the swivel table 30 is kept constant. In this way, the swivel table 30 supports the rotary truer 43 via the base 41 and the truer driving mechanism 42 such that the rotary truer 43 is swivelable about the swivel axis Ac that is parallel to an axis perpendicular to the central axis Aw of the grinding wheel 11.

In the swiveling truing device 3, for example, the base 41 is moved by driving the truer head linear movement axis motor 33 to move the rotary truer 43 in the radial direction of the swivel table 30. Then, the truing edge position of the rotary truer 43 relative to the swivel axis Ac is set. Subsequently, the swivel table 30 is swiveled to swivel the rotary truer 43 with the distance from the truing edge position of the rotary truer 43 to the swivel axis Ac kept constant. Note that, the "truing edge position" of the rotary truer 43 is a position of the outer peripheral surface of the rotary truer 43, which is closest to the swivel axis Ac of the swivel table 30 within the outer peripheral surface. In addition, the truer driving mechanism 42 of the truer head 40 is controlled by the controller 60. Thus, for example, the rotational speed of the rotary truer 43 of the truer head 40 is controlled.

Figure 3:
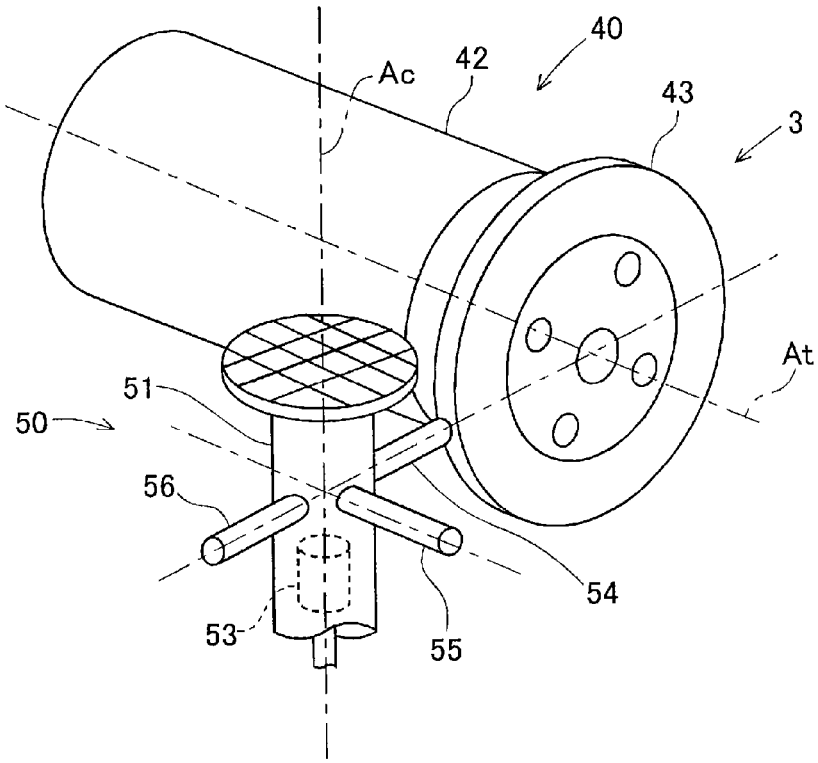
FIG. 3 is an enlarged perspective view that shows a rotary truer and a sensor unit in the truing device shown in FIG. 1 and FIG. 2.

The sensor unit 50 is detecting means for detecting the distance from the truing edge position of the rotary truer 43 to the swivel axis Ac of the swivel table 30. As shown in FIG. 3, the sensor unit 50 includes a sensor body 51, a sensor driving device 52 (FIG. 1), an AE sensor 53, a truer detecting pin 54, a grinding wheel end face detecting pin 55 and a grinding wheel outer peripheral surface detecting pin 56. The sensor body 51 is formed into a cylindrical shape as a whole, and is arranged such that the central axis of the cylindrical shape coincides with the swivel axis Ac of the swivel table 30. In addition, the sensor body 51 is supported by the swivel table 30 such that relative rotation between the sensor body 51 and the swivel table 30 is possible. Thus, the sensor body 51 kept at a predetermined phase irrespective of the swivel operation of the swivel table 30. The sensor driving device 52 is arranged at the swivel center portion of the swivel table 30, and moves the sensor body 51 in the direction along the swivel axis Ac.

The AE sensor 53 is accommodated inside the cylindrical sensor body 51, and detects an acoustic emission (AE) signal generated upon the contact of a contactor, such as a detecting pin, with an object. The truer detecting pin 54, the grinding wheel end face detecting pin 55 and the grinding wheel outer peripheral surface detecting pin 56 are detecting pins (each of which may function as "contact detecting member" according to the invention) of the AE sensor 53, and are fixedly held by the sensor body 51 as shown in FIG. 3. In addition, the detecting pins 54, 55, 56 are arranged such that the tip end portions thereof are oriented radially outward with respect to the swivel center O of the swivel table 30 and are oriented in directions different from one another. More specifically, the detecting pins 54, 55, 56 are arranged on the outer peripheral surface of the sensor body 51 at intervals of 90° in the circumferential direction such that the extending directions thereof are parallel to the upper face of the swivel table 30.

With the above configuration, the sensor unit 50 detects the contact of the truer detecting pin 54 with the rotary truer 43 with the use of the AE sensor 53. Thus, the sensor unit 50 detects the fact that the distance from the truing edge position of the rotary truer 43 to the swivel center O of the swivel table 30 has reached a detection distance L. In addition, the sensor unit 50 detects the contact of the grinding wheel end face detecting pin 55 with an end face of the grinding wheel 11, which is located at one side of the grinding wheel 11 in the direction of the central axis Aw, with the use of the AE sensor 53. Similarly, the sensor unit 50 detects the contact of the grinding wheel outer peripheral surface detecting pin 56 with a radially outermost portion of the outer peripheral surface of the grinding wheel 11 with the use of the AE sensor 53.

In addition, in the present embodiment, the length of the truer detecting pin 54 is set in advance such that the detection distance L coincides with the radius of the rounded-off portion on the outer peripheral surface of the grinding wheel 11. Thus, the rotary truer 43 is moved relative to the truer detecting pin 54 of the sensor unit 50, and the sensor unit 50 detects the contact of the rotary truer 43 with the truer detecting pin 54 when the distance between the swivel center O and the truing edge position of the rotary truer 43 reaches the detection distance L. That is, in order to enable the above detection, the tip end portion of the truer detecting pin 54 is set as a portion that detects contact with the rotary truer 43, and the truer detecting pin 54 is formed such that the detection distance L from the swivel center O to the tip end portion coincides with the radius of the arc sectional shape of the grinding wheel 11 at the outer peripheral surface. In addition, the sensor driving device 52 of the sensor unit 50 is controlled by the controller 60, and the sensor unit 50 outputs an AE signal to the controller 60.

In grinding, the controller 60 executes numerical control (NC) on the axis positions of the grinding wheel head 10 and the rotation of the headstock 21. Then, the controller 60 rotates the built-in motor of the truer driving mechanism 42 to rotate the rotary truer 43. In this way, in the grinding machine 1, the controller 60 controls the axis positions of the grinding wheel head 10 relative to the workpiece W while the grinding wheel 11 is rotated. In this way, the outer peripheral surface of the workpiece W is ground. In addition, in truing, the controller 60 executes numerical control (NC) on the axis positions of the grinding wheel head 10 and the swivel angle of the swivel table 30 with the rotary truer 43 kept rotating, and corrects the shape of the grinding wheel 11 with the use of the rotary truer 43 or detects the contact of the detecting pins with the respective portions.

Next, with reference to FIG. 3 to FIG. 6, description will be provided regarding the operation for truing the grinding wheel 11 and the detection of the positions of the grinding wheel 11 and the rotary truer 43 with the use of the sensor unit 50 in the truing device 3 of the above-described grinding machine 1. First, when a command to start truing the grinding wheel 11 is issued, the sensor unit 50 detects the truing edge position of the rotary truer 43. Therefore, the controller 60 commands the sensor driving device 52 to move the sensor body 51 upward in the direction along the swivel axis Ac of the swivel table 30. At this time, the controller 60 controls the sensor driving device 52 such that the truer detecting pin 54 is located at the same height as the central axis At of the rotary truer 43. Furthermore, the swivel table 30 is swiveled such that the central axis of the truer detecting pin 54 is perpendicular to the central axis At of the rotary truer 43.

Figure 4:
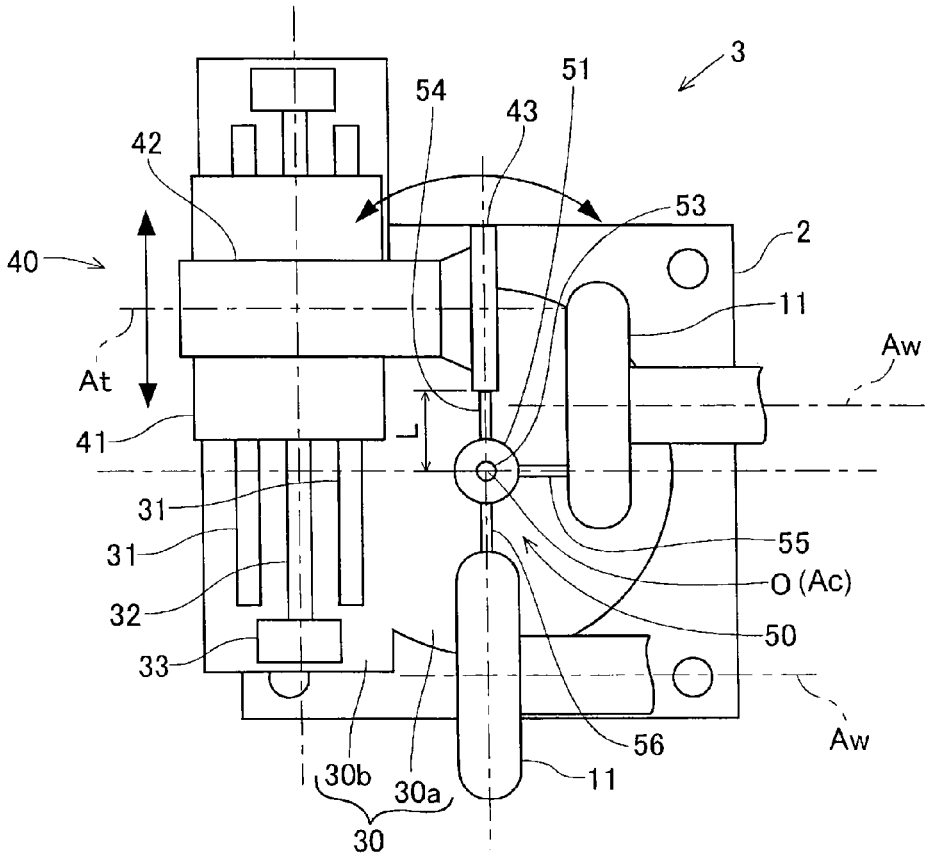
FIG. 4 is a plan view that shows a state where the position of a grinding wheel and the position of the rotary truer are detected by the sensor unit.

Then, the controller 60 moves the base 41 at a predetermined speed so as to bring the rotary truer 43 close to the sensor unit 50 with the rotary truer 43 rotated at a predetermined rotational speed by the truer driving mechanism 42. After that, as shown in FIG. 3 and FIG. 4, the sensor unit 50 detects the contact of the truer detecting pin 54 with the truing edge of the rotary truer 43 with the use of the AE sensor 53. Thus, the sensor unit 50 detects the fact that the truing edge position of the rotary truer 43 is located at the detection distance L from the swivel center O, using the swivel center O of the swivel table 30 as the reference position.

In addition, the controller 60 receives the AE signal from the sensor unit 50 when the truer detecting pin 54 contacts the rotary truer 43, and stores the current position of the base 41 at this moment. The difference between the stored current position of the base 41 and the control position of the base 41 corresponds to the positional deviation of the rotary truer 43. The base 41 should be placed in the control position in order to make the distance between the truing edge position of the rotary truer 43 and the swivel center O equal to the distance L. The positional deviation occurs due to installation errors of the members, abrasion of the rotary truer 43, thermal displacement of the device itself, and the like, in the swiveling truing device 3. In the present embodiment, the controller 60 detects the positional deviation of the rotary truer 43 in this way.

Subsequently, the end face position and outer peripheral surface position of the grinding wheel 11 are detected by the sensor unit 50. At this time, the sensor unit 50 is kept at the position at which the sensor unit 50 detects the truing edge position of the rotary truer 43. That is, the position of the grinding wheel 11 is detected using the swivel center O of the swivel table 30 as the reference position. Then, the controller 60 first rotates the grinding wheel 11 at a predetermined rotational speed and controls, in this state, the actuating mechanism of the grinding wheel head 10 so as to move the grinding wheel 11 in the direction along the central axis Aw. After that, as shown in FIG. 4, the sensor unit 50 detects the contact of the grinding wheel end face detecting pin 55 with one end face of the grinding wheel 11, which is located at one side of the grinding wheel 11 in the direction of the central axis Aw, with the use of the AE sensor 53.

Similarly, the controller 60 moves the grinding wheel 11 in the direction perpendicular to the central axis Aw with the grinding wheel 11 kept rotating, and detects the contact of the grinding wheel outer peripheral surface detecting pin 56 with the radially outermost portion of the outer peripheral surface of the grinding wheel 11 with the use of the AE sensor 53. Thus, the sensor unit 50 detects the fact that the end face position and the outer peripheral surface position of the grinding wheel 11 are at respective predetermined distances from the swivel center O, using the swivel center O of the swivel table 30 as the reference position. In addition, the controller 60 receives the AE signal from the sensor unit 50 when each of the grinding wheel detecting pins 55, 56 contacts the grinding wheel 11, and stores the current position of the grinding wheel head 10 at this moment.

Subsequently, correction of the shape of the grinding wheel 11 made by the truing device 3 will be described. In the present embodiment, as described above, the sectional shape of the grinding wheel 11 at the outer peripheral surface is a rounded-off shape. The controller 60 first controls the actuating mechanism of the grinding wheel head 10 so as to move the grinding wheel 11 to a predetermined position for truing. More specifically, the grinding wheel 11 is positioned such that the center of the rounded-off arc shape coincides with the swivel center O of the swivel table 30. Then, the controller 60 commands the driving device of the grinding wheel head 10 to rotate the grinding wheel 11 at a predetermined rotational speed.

Subsequently, the controller 60 commands the truer driving mechanism 42 to rotate the rotary truer 43 at a predetermined rotational speed. Then, in a state where the rotary truer 43 is kept rotating, the swivel table 30 and the base 41 are moved such that the truing edge position of the rotary truer 43 contacts the starting point of the arc shape of the outer peripheral surface of the grinding wheel 11. At this time, the position of the base 41 is set on the basis of the position stored in the controller 60 when the positions of the rotary truer 43 and grinding wheel 11 are detected.

Figure 5:
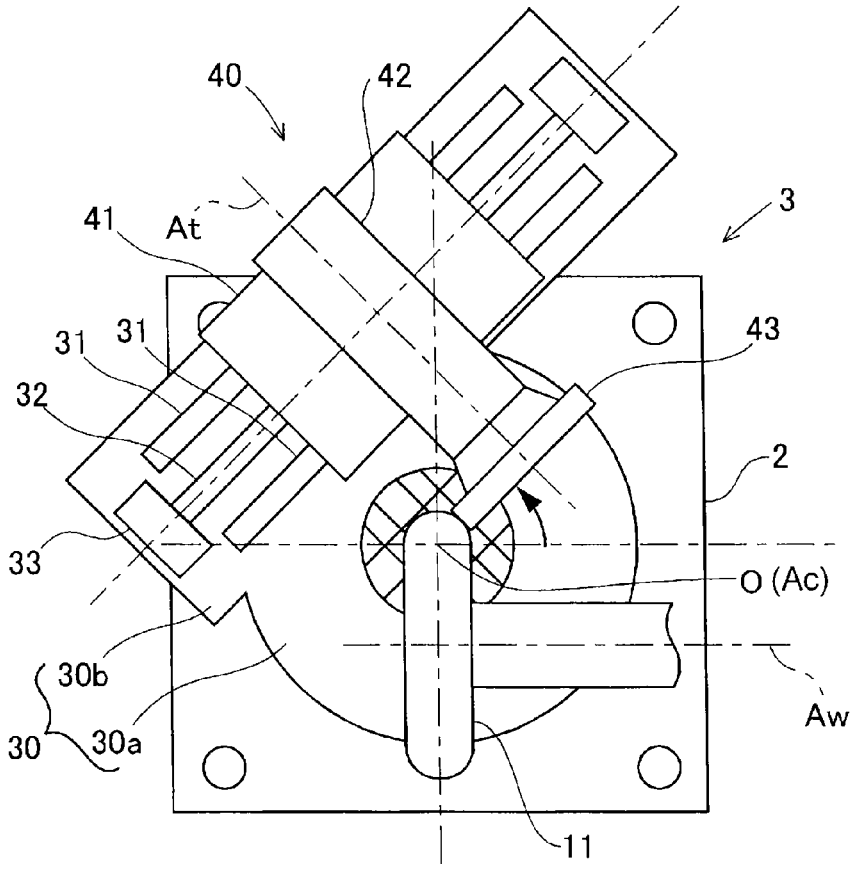
FIG. 5 is a plan view that shows a state where one axial end of the grinding wheel is being trued.
Figure 6:
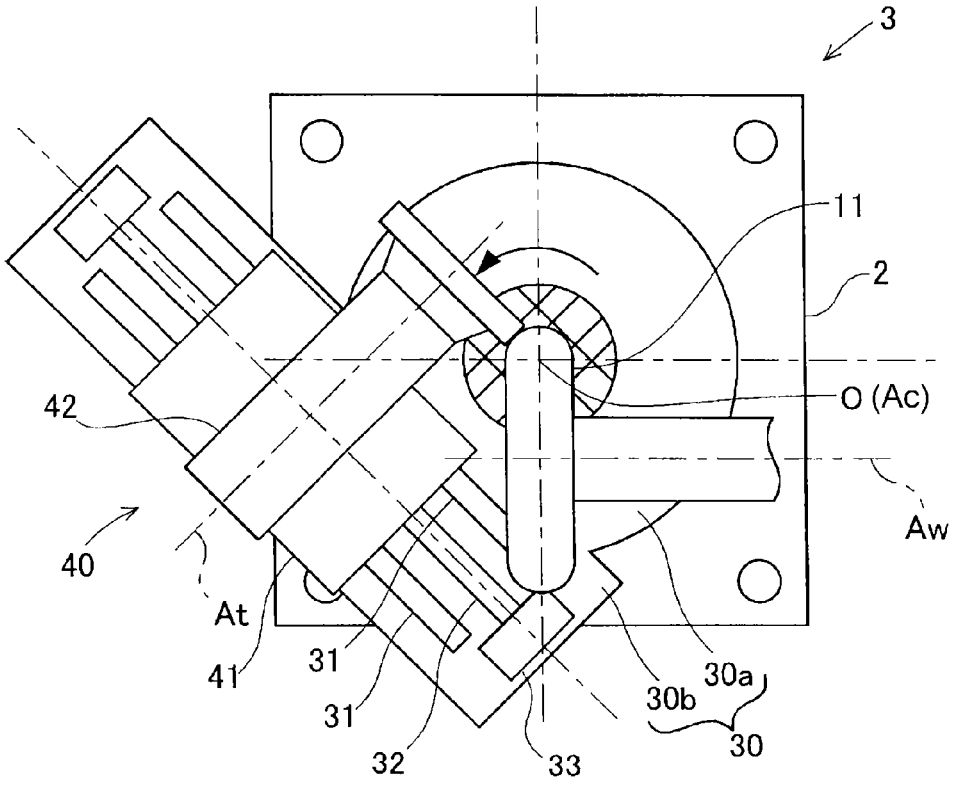
FIG. 6 is a plan view that shows a state where the other axial end of the grinding wheel is being trued.

Then, the swivel table 30 is swiveled as shown in FIG. 5 with the rotary truer 43 in contact with the outer peripheral surface of the grinding wheel 11. At this time, the base 41 is kept at the position at which the base 41 is initially positioned relative to the swivel table 30. Furthermore, as shown in FIG. 6, the swivel table 30 is swiveled until the truing edge position of the rotary truer 43 reaches the end point of the arc shape of the outer peripheral surface of the grinding wheel 11. In this way, the cylindrical outer peripheral surface of the rotary truer 43 is swiveled with the distance from the swivel center O to the outer peripheral surface of the rotary truer 43 kept constant. Therefore, the sectional shape of the grinding wheel 11 at the outer peripheral surface is formed into an arc shape.

The truing device 3 of the grinding machine 1 trues the grinding wheel 11 as described above. In addition, the truing device 3 may detect the end face position and outer peripheral surface position of the grinding wheel 11 again after correcting the shape of the grinding wheel 11. Thus, the difference between the position of the grinding wheel 11 detected before the truing and the position of the grinding wheel 11 detected after the truing is calculated to check whether the truing is appropriately carried out. Furthermore, the end face positions and outer peripheral surface positions of the grinding wheel 11, detected before and after the truing, and the truing edge position of the rotary truer 43 are utilized to calculate the amount of abrasion of the rotary truer 43 and the amount of abrasion of each of the detecting pins 54, 55, 56.

In the present embodiment, the sectional shape of the grinding wheel 11 at the outer peripheral surface is an arc shape. Other than that, the grinding wheel 11 may be formed into a shape partially having an arc sectional shape, such as a concave shape. In such a case, when the shape of the grinding wheel 11 is corrected, the grinding wheel head 10 is controlled in synchronization with the operation of the swivel table 30 as needed. Then, when the sectional shape of the grinding wheel 11 is a concave shape as described above, truing is carried out such that the center of the arc portion of the concave shape coincides with the swivel center O of the swivel table 30.

Furthermore, the grinding wheel 11 may be formed into a shape of which the curvature radius of the sectional shape gradually changes, such as a composite rounded-off shape. In such a case, when the shape of the grinding wheel 11 is corrected, the grinding wheel head 10 and the base 41 are controlled in synchronization with the operation of the swivel table 30 as needed. That is, by moving the rotary truer 43 in the radial direction of the swivel table 30, the distance from the truing edge position of the rotary truer 43 to the swivel center O of the swivel table 30 is changed to make it possible to correct the shape of the grinding wheel 11 having various shapes.

In addition, in the present embodiment, the length of the truer detecting pin 54 is set in advance on the basis of the radius of the rounded-off portion of the outer peripheral surface of the grinding wheel 11. Alternatively, when the length of the truer detecting pin 54 is set on the basis of a radius different from the radius of the rounded-off portion, the truing edge position of the rotary truer 43 is corrected by an amount corresponding to the radius difference with the use of the base 41.

Next, advantageous effects of the truing device 3 of the grinding machine 1 will be described. The above-described truing device 3 of the grinding machine 1 is configured such that the rotary truer 43, and the like, are controlled and truing is carried out on the basis of the distance detected by the sensor unit 50. The distance detected by the sensor unit 50 is a distance from the truing edge position of the rotary truer 43 to the swivel center O of the swivel table 30, which is directly detected. That is, the detection distance is a distance that is detected with the rotary truer 43 positioned in truing. Therefore, because the controller 60 positions the rotary truer 43 on the basis of the detection distance, it is possible to carry out truing taking into account the positional deviation due to, for example, the amount of abrasion of the rotary truer 43 without the influence of the rotation runout of the grinding wheel 11, the thermal displacement of the grinding machine 1, and the like. Accordingly, the truing device 3 is able to carry out truing with higher accuracy. Therefore, even when the sectional shape of the grinding wheel 11 at the outer peripheral surface is a complex shape, such as a curved surface shape, the influence of the shape is suppressed and truing is carried out with high accuracy.

The sensor unit 50 is supported by the swivel table 30. Thus, when the position of the sensor unit 50 relative to the rotary truer 43, which is a detection target, is adjusted by the swivel table 30, it is possible to perform detection taking into account the influence of the operation of the swivel table 30 that is controlled in truing. Therefore, it is possible to more accurately detect the position of the rotary truer 43. Furthermore, in this configuration, the sensor unit 50 is arranged at a position closer to the position at which truing is actually carried out, than in the conventional configuration. Thus, it is possible to more accurately detect the distance from the truing edge position of the rotary truer 43 to the swivel center O, taking into account the positional deviation due to the operations of the other members, such as the swivel table 30. Thus, it is possible to improve the accuracy of truing.

In addition, the sensor unit 50 is supported so as to be movable in the direction along the swivel axis Ac of the swivel table 30 by the sensor driving device 52. Thus, in the truing device 3, the sensor unit 50 is arranged near the position at which truing is actually carried out. In addition, the sensor unit 50 is arranged along the swivel axis Ac of the swivel table 30, and detects the distance from the truing edge position of the rotary truer 43 to the swivel center O, using the swivel center O as the reference position. Thus, it is possible to detect the distance more accurately as compared with the conventional method in which the distance is indirectly calculated.

Furthermore, at the time of truing, the controller 60 controls the truing edge position of the rotary truer 43 relative to the grinding wheel 11 on the basis of the distance detected by the sensor unit 50. In addition, the positional relationship between the sensor unit 50 and the rotary truer 43 is adjusted by the base 41 that supports the rotary truer 43, and the sensor unit 50 detects the distance from the truing edge position of the rotary truer 43 to the swivel center O. Thus, the swivel table 30 and the base 41, which are controlled in truing, are used to detect the position of the rotary truer 43. Therefore, the sensor unit 50 is able to detect the distance from the truing edge position of the rotary truer 43 to the swivel center O under the same conditions as those in the actual truing. In addition, the positional deviation of the rotary truer 43 is corrected based on the movement amount of the base 41. Therefore, it is possible to further easily and reliably carry out truing with higher accuracy without correcting a position command value for the grinding wheel head 10 unlike in the conventional art.

The sensor unit 50 detects the distance from the truing edge position of the rotary truer 43 to the swivel center O through the contact of the truer detecting pin 54 with the rotary truer 43, detected using the swivel center O of the swivel table 30 as the reference position. Thus, the rotary truer 43 is moved in the radial direction of the swivel table 30 by the base 41. As a result, the truer detecting pin 54 detects the contact with the rotary truer 43, and the sensor unit 50 reliably detects the distance from the truing edge position of the rotary truer 43 to the swivel center O.

In addition, the truer detecting pin 54 is formed such that the distance from the swivel center O of the swivel table 30 to the tip end portion that detects the contact coincides with the radius of the rounded-off portion of the outer peripheral surface of the grinding wheel 11. That is, the position of the rotary truer 43 detected by the sensor unit 50 after the rotary truer 43 is moved by the base 41 corresponds to the position of the rotary truer 43 when the rotary truer 43 rounds off the grinding wheel 11. Thus, by swiveling the rotary truer 43 at this position, the grinding wheel 11 is formed into an arc shape.

The sensor unit 50 detects the end face position and outer peripheral surface position of the grinding wheel 11 with the use of the grinding wheel detecting pins 55, 56 that detect contact with the grinding wheel 11. In addition, the grinding wheel end face detecting pin 55 and the grinding wheel outer peripheral surface detecting pin 56, in addition to the truer detecting pin 54, are fixedly held by the sensor body 51. With such a configuration, when the sensor unit 50 detects the positions of the rotary truer 43 and grinding wheel 11, the same reference position is used in the detections. Thus, corrections of the positional deviation and amount of abrasion of the rotary truer 43 are appropriately reflected on truing, which improves the accuracy of truing. Furthermore, by detecting the end face position and outer peripheral surface position of the grinding wheel 11 with the use of the grinding wheel end face detecting pin 55 and the grinding wheel outer peripheral surface detecting pin 56, it is possible to, for example, calculate the amount of abrasion of the grinding wheel 11 and detect the positional deviation of the grinding wheel 11.

A second embodiment of the invention will be described below. A grinding machine 101 according to the second embodiment of the invention will be described with reference to FIG. 7. The grinding machine 101 in the present embodiment differs from the grinding machine 1 in the first embodiment mainly in the configuration of a sensor unit 150 in a truing device 103. The other structures are substantially the same as those of the first embodiment, so the detailed description thereof is omitted. Hereinafter, only the difference will be described.

Figure 7:
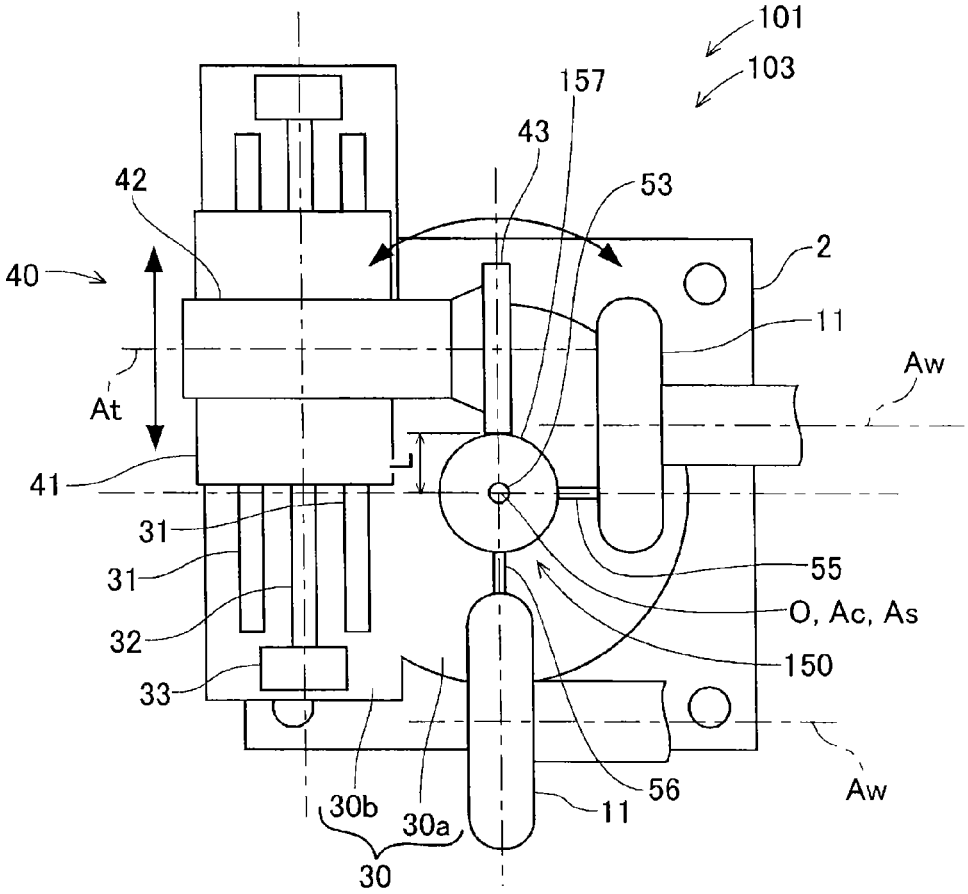
FIG. 7 is a plan view that shows a state where the position of the grinding wheel and the position of the rotary truer are detected by a sensor unit according to a second embodiment of the invention.

As shown in FIG. 7, the truing device 103 includes the swivel table 30, the truer head 40 and the sensor unit 150 (which may function as "detecting means" according to the invention). The sensor unit 150 includes a columnar sensor 157, the sensor driving device 52, the AE sensor 53, the grinding wheel end face detecting pin 55 and the grinding wheel outer peripheral surface detecting pin 56. The columnar sensor 157 is a contact detecting member that detects contact with an object, at its outer peripheral surface, and is a contactor of the AE sensor 53. The contactor of the AE sensor 53 accommodates the AE sensor 53. In the present embodiment, the columnar sensor 157 is arranged such that the central axis As coincides with the swivel axis Ac of the swivel table 30, and is formed in a columnar shape that extends in the direction along the swivel axis Ac (central axis As). In the present embodiment, the columnar sensor 157 is formed into a cylindrical columnar shape so that the sectional shape perpendicular to the central axis As is circular.

In addition, the columnar sensor 157 also serves as a sensor body of the sensor unit 150, and supports the grinding wheel end face detecting pin 55 and the grinding wheel outer peripheral surface detecting pin 56. The detecting pins 55, 56 are provided such that the respective tip end portions are oriented radially outward with respect to the swivel center O of the swivel table 30 and are oriented in directions different from each other. Furthermore, the columnar sensor 157 is supported by the swivel table 30 such that relative rotation between the columnar sensor 157 and the swivel table 30 is possible. Thus, the columnar sensor 157 is kept at a predetermined phase irrespective of the swivel operation of the swivel table 30.

With such a configuration, the sensor unit 150 detects the contact of the outer peripheral surface of the columnar sensor 157 with the rotary truer 43 with the use of the AE sensor 53. Thus, the sensor unit 150 detects the fact that the distance from the truing edge position of the rotary truer 43 to the swivel center O of the swivel table 30 has reached a detection distance L. In addition, the sensor unit 150 detects the contact of the grinding wheel end face detecting pin 55 with an end face of the grinding wheel 11, which is located at one side of the grinding wheel 11 in the direction of the central axis Aw, with the use of the AE sensor 53. Similarly, the sensor unit 150 detects the contact of the grinding wheel outer peripheral surface detecting pin 56 with the radially outermost portion of the outer peripheral surface of the grinding wheel 11 with the use of the AE sensor 53.

In addition, in the present embodiment, the radius of the columnar sensor 157 is set in advance such that the detection distance L coincides with the radius of the rounded-off portion on the outer peripheral surface of the grinding wheel 11. Thus, the rotary truer 43 is moved relative to columnar sensor 157, and the sensor unit 150 detects the contact of the rotary truer 43 with columnar sensor 157 when the distance between the swivel center O and the truing edge position of the rotary truer 43 reaches the detection distance L.

In the present embodiment, in detection of the position of the rotary truer 43, the controller 60 executes control to change a portion of the outer peripheral surface of the columnar sensor 157, the portion contacting the rotary truer 43. More specifically, the controller 60 swivels the swivel table 30 to an angle different from an angle at the time of previous detection. In this way, the columnar sensor 157 is rotated about the swivel axis Ac relative to the rotary truer 43 to change a portion of the outer peripheral surface of the columnar sensor 157, the portion detecting contact with the rotary truer 43, in the circumferential direction of the columnar sensor 157.

Similarly, the controller 60 controls the sensor driving device 52 to raise or lower the columnar sensor 157 to a height that is different from a height at the time of previous detection. In this way, the columnar sensor 157 is moved in the direction along the swivel axis Ac relative to the rotary truer 43 to change the portion of the outer peripheral surface of the columnar sensor 157, the portion detecting contact with the rotary truer 43, in the axial direction of the columnar sensor. As described above, in detection of the position of the rotary truer 43, the columnar sensor 157 is controlled such that the contact portion is changed as needed. The other truing operation is the same as that in the first embodiment, so the detailed description thereof is omitted.

Advantageous effects of the truing device of the grinding machine will be described. With the above-described truing device 103 of the grinding machine 101, advantageous effects similar to those of the first embodiment are obtained. In addition, the sensor unit 150 of the truing device 103 has the columnar sensor 157. Further, the portion of the outer peripheral surface of the columnar sensor 157, the portion detecting contact with the rotary truer 43, is changed in the circumferential direction and in the axial direction. Thus, the area of the portion of the outer peripheral surface of the columnar sensor 157, which serves as a contact detecting member, the portion being able to detect the rotary truer 43, is increased in the circumferential direction and in the axial direction. Therefore, the influence of abrasion on the columnar sensor 157 is reduced. Thus, it is possible to detect the truing edge position of the truer with higher accuracy.

Hereafter, alternative embodiments of the first embodiment and the second embodiment will be described. In the first embodiment and the second embodiment, the sensor units 50, 150 are supported so as to be movable by the swivel table 30 in the direction along the swivel axis Ac. Alternatively, the sensor units 50, 150 may be arranged at a position spaced apart from the swivel table 30. However, in order for the sensor units 50, 150 to detect the distance from the truing edge position of the rotary truer 43 to the swivel center O under the same condition as those of actual truing, it is desirable to employ the configuration described in the first embodiment and the second embodiment.

In addition, the truing devices 3, 103 have the base 41 that serves as a movable body that moves the rotary truer 43 in the radial direction of the swivel table 30. Alternatively, for example, in a grinding machine in which the grinding wheel head 10 has a mechanism that is swivelable about an axis parallel to the swivel axis Ac, even when no movable body is provided, it is possible to carry out grinding and truing by executing synchronous control over the driving devices for the respective axes.

The sensor units 50, 150 that serve as detecting means each include the AE sensor 53 that detects the contact of the truer detecting pin 54 or the columnar sensor 157 with the rotary truer 43. Alternatively, the sensor need not be a contact sensor as long as the sensor is able to detect the position of the rotary truer 43. For example, the sensor units 50, 150 may have a sensor that uses eddy current, laser, or the like. In the first embodiment and the second embodiment, the multiple detecting pins for the purpose of different applications are provided, and, in the second embodiment, the columnar sensor 157 that detects contact at its cylindrical outer peripheral surface is provided. The common AE sensor 53 is used to detect an AE signal generated through the contact of these pins and sensor to thereby reduce the costs of the sensor units 50, 150.

In addition, the multiple detecting pins are provided according to application; instead, for example, the end face position and outer peripheral surface position of the grinding wheel 11 may be detected by a single grinding wheel detecting pin. Furthermore, only the columnar sensor 157 serves as a contact detecting member without providing any detecting pin. That is, in the second embodiment, one of or both of the grinding wheel end face detecting pin 55 and the grinding wheel outer peripheral surface detecting pin 56 may be omitted and the position of the rotary truer 43 and the end face position or outer peripheral surface position of the grinding wheel 11 may be detected by the outer peripheral surface of the columnar sensor 157.

In addition, in such a configuration in which no detecting pin is provided, the columnar sensor 157 may be rotated about the swivel axis Ac relative to the grinding wheel 11 or the columnar sensor 157 may be moved in the direction along the swivel axis Ac relative to the grinding wheel 11. Thus, the portion of the outer peripheral surface of the columnar sensor 157, the portion detecting contact with the grinding wheel 11, is changed in the circumferential direction and in the axial direction. Thus, the area of the portion of the outer peripheral surface of the columnar sensor 157, which serves as a contact detecting member, the portion being able to detect the grinding wheel 11, is increased in the circumferential direction and in the axial direction. Therefore, the influence of abrasion on the columnar sensor 157 is reduced. Thus, it is possible to detect the end face position and outer peripheral surface position of the grinding wheel 11.

Other than the above, the truer that corrects the shape of the grinding wheel 11 is the rotary truer 43 that has a disc shape and that is rotated by the truer driving mechanism 42. Alternatively, the truer may be a single-point truer that carries out truing while only the grinding wheel 11 is rotated. In such a configuration as well, as long as the truing device is of a swiveling type, the invention is applied to obtain similar advantageous effects as those described above.

A third embodiment of the invention will be described below. A grinding wheel of a grinding machine is abraded through grinding and is then corrected into a predetermined shape through truing. In order to more accurately carry out grinding or truing in the grinding machine, it is necessary to highly accurately obtain the positions of the end face and outer peripheral surface of the grinding wheel. In response to this, for example, Japanese Patent Application Publication No. 2007-175815 (JP 2007-175815 A) describes a method in which a detecting pin is brought into contact with a grinding wheel to obtain the position and outside diameter of the outer peripheral surface of the grinding wheel. However, in such a method, there is concern about the influence of abrasion of the detecting pin on detection accuracy. Therefore, a grinding machine, to which part of the configuration of the present invention is applied so that the positions of the end face and outer peripheral surface of the grinding wheel are detected with higher accuracy, will be described as the third embodiment of the invention.

The configuration of a grinding machine will be described first. A grinding machine 201 according to the third embodiment of the invention will be described with reference to FIG. 8 and FIG. 9. The grinding machine 201 is a machine tool that moves the grinding wheel 11 relative to the workpiece W supported on a bed (not shown) to carry out grinding. The grinding machine 201 includes a grinding wheel head 210, the workpiece support device 20, a sensor unit 250 and the controller 60.

The grinding wheel head 210 includes the grinding wheel 11 that grinds the workpiece W. The grinding wheel head 210 is arranged on guide rails (not shown) that are arranged on the upper face of the bed (not shown) and that extend in the direction along the central axis Aw of the grinding wheel 11. In addition, the grinding wheel head 210 has an actuating mechanism that moves the grinding wheel 11 in the direction that is perpendicular to the direction in which the guide rails extend and that is parallel to the upper face of the bed. Furthermore, the actuating mechanism enables the grinding wheel 11 to swivel about a swivel axis Ad that is perpendicular to both of the directions in which the grinding wheel 11 is moved as described above.

The grinding wheel 11 is formed, for example, by bonding hard abrasive grains to the outer periphery of a disc-shaped metal core. In addition, the grinding wheel 11 is supported by the grinding wheel head 210 via the actuating mechanism of the grinding wheel head 210. Thus, the grinding wheel 11 is movable in the axial direction and radial direction of the workpiece W. For example, movement in each axial direction, swivel angle, and rotational speed of the grinding wheel 11 of the thus configured grinding wheel head 210 are controlled by the controller 60.

The workpiece support device 20 supports both ends of the workpiece W such that the workpiece W is rotatable about the central axis of the workpiece W. The workpiece support device 20 includes the headstock 21 and the tailstock 22. The headstock 21 supports one end of the workpiece W. The tailstock 22 is arranged to face the headstock 21, and supports the other end of the workpiece W. The headstock 21 includes a spindle that is rotated by a rotary driving device (not shown), and is configured such that the workpiece W rotates as the spindle is rotated. In addition, for example, the rotational speed and rotation phase of the spindle of the headstock 21 are controlled by the controller 60.

Figure 8:
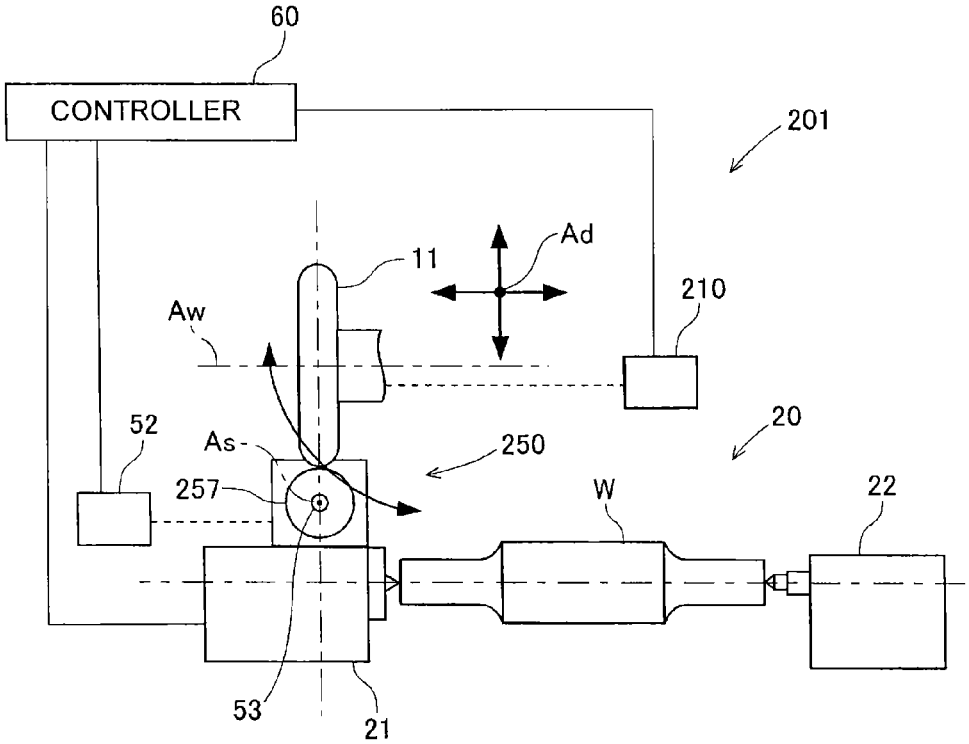
FIG. 8 is a plan view that shows a state where the position of the grinding wheel is detected by a sensor unit according to a third embodiment of the invention.

The sensor unit 250 is detecting means for detecting the position of the grinding wheel 11. As shown in FIG. 8, the sensor unit 250 includes a columnar sensor 257, the sensor driving device 52 and the AE sensor 53. The columnar sensor 257 is a contact detecting member that detects contact with an object, at its outer peripheral surface, and is a contactor of the AE sensor 53. The contactor of the AE sensor 53 accommodates the AE sensor 53. The columnar sensor 257 is arranged such that the central axis As is parallel to the swivel axis Ad of the actuating mechanism of the grinding wheel head 210, and is formed into a cylindrical columnar shape that extends in the direction along the central axis As.

With such a configuration, the sensor unit 250 detects the contact of the outer peripheral surface of the columnar sensor 257 with one end face of the grinding wheel 11, which is located at one side of the grinding wheel 11 in the direction of the central axis Aw, with the use of the AE sensor 53. Similarly, the sensor unit 250 detects the contact of the grinding wheel outer peripheral surface detecting pin 56 with the radially outermost portion of the outer peripheral surface of the grinding wheel 11 with the use of the AE sensor 53.

In addition, when the controller 60 detects the position of the grinding wheel 11, the controller 60 executes control so as to change a portion of the outer peripheral surface of the columnar sensor 257, the portion contacting the grinding wheel 11. More specifically, the controller 60 commands the actuating mechanism of the grinding wheel head 210 to swivel the grinding wheel 11 to an angle different from an angle at the time of previous detection. In this way, the columnar sensor 257 is rotated about the central axis As relative to the grinding wheel 11 to change a portion of the outer peripheral surface of the columnar sensor 257, the portion detecting contact with the grinding wheel 11, in the circumferential direction of the columnar sensor 257.

Figure 9:
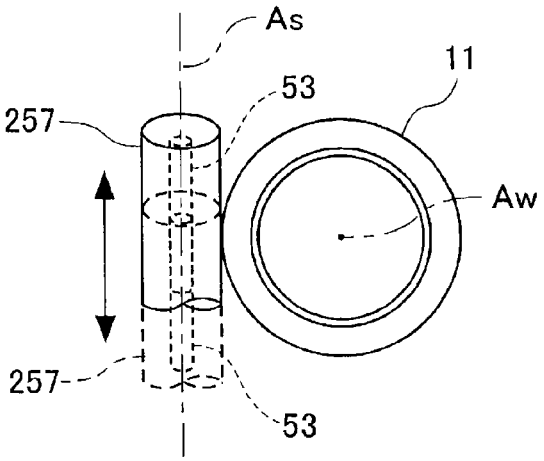
FIG. 9 is a perspective view that shows the grinding wheel and a columnar sensor in a grinding machine shown in FIG. 8.

Similarly, the controller 60 controls the sensor driving device 52 to raise or lower the columnar sensor 257 to a height that is different from a height at the time of previous detection as shown in FIG. 9. In this way, the columnar sensor 257 is moved in the direction along the swivel axis Ad (central axis As) relative to the grinding wheel 11 to change the portion of the outer peripheral surface of the columnar sensor 257, the portion detecting contact with the grinding wheel 11, in the axial direction of the columnar sensor 257. As described above, in detection of the position of the grinding wheel 11, the columnar sensor 257 is controlled such that the contact portion is shifted as needed.

Next, advantageous effects of the grinding machine will be described. With the above-described grinding machine 201, the columnar sensor 257 is moved relative to the grinding wheel 11 to change the portion of the outer peripheral surface of the columnar sensor 257, the portion contacting with the grinding wheel 11, in the circumferential direction and the axial direction. Thus, the area of the portion of the outer peripheral surface of the columnar sensor 257, the portion being able to detect the grinding wheel 11, is increased in the circumferential direction and in the axial direction. Thus, the influence of abrasion on the columnar sensor 257 is reduced, so it is possible to highly accurately detect the position and outside diameter of the outer peripheral surface of the grinding wheel 11. Thus, it is possible to correct the positional deviation in positioning the grinding wheel 11 in grinding and truing, thereby improving the accuracy of grinding and truing.

In the above-described third embodiment, the actuating mechanism of the grinding wheel head 210 and the sensor driving device 52 of the sensor unit 250 are used to move the columnar sensor 257 relative to the grinding wheel 11. The actuating mechanism is used to move the columnar sensor 257 relative to the grinding wheel 11 in the circumferential direction. The sensor driving device 52 is used to move the columnar sensor 257 relative to the grinding wheel 11 in the axial direction. However, as long as the grinding wheel 11 and the columnar sensor 257 are movable relative to each other, a configuration, other than the illustrated configuration, is also applicable. For example, in the configuration in which the actuating mechanism of the grinding wheel head 210 has no swivel function, if the sensor driving device 52 of the sensor unit 250 further has the function of rotating the columnar sensor 257 about the central axis As, similar advantageous effects are obtained.

What is claimed is:

1. A truing device of a grinding machine, comprising:

a truer that corrects a shape of a grinding wheel;

a swivel table that supports the truer such that the truer is swivelable about an axis that is perpendicular to a central axis of the grinding wheel;

a detector to directly detect a distance from a truing edge position of the truer, which contacts the grinding wheel during correction of the shape of the grinding wheel, to a swivel center of the swivel table; and circuitry configured to control the truing edge position of the truer relative to the grinding wheel based on the distance detected by the detector to true the grinding wheel.

2. The truing device according to claim 1, wherein the detector is supported by the swivel table.

3. The truing device according to claim 2, wherein the detector is supported so as to be movable in a direction along a swivel axis of the swivel table.

4. The truing device according to claim 2, further comprising:

a movable body that is provided on the swivel table, and that supports the truer such that the truer is movable in a radial direction of the swivel table.

5. The truing device according to claim 2, wherein:

the detector has a contact detecting member that detects contact with an object; and the detector detects contact with the truer with use of the contact detecting member, using the swivel center of the swivel table, as a reference position, to detect the distance from the truing edge position of the truer to the swivel center of the swivel table.

6. The truing device according to claim 5, wherein when at least part of a sectional shape of the grinding wheel at an outer peripheral surface located at a radially outer side is trued into an arc shape, the contact detecting member is formed such that a distance from the swivel center of the swivel table to a portion of the contact detecting member, which detects contact with the truer, coincides with a radius of the arc shape of the sectional shape of the grinding wheel at the outer peripheral surface.

7. The truing device according to claim 5, wherein:

the contact detecting member includes a truer detecting pin and a grinding wheel detecting pin;

the detector includes the truer detecting pin that detects contact with the truer, the grinding wheel detecting pin that detects contact with the grinding wheel, and a sensor body that fixedly holds the truer detecting pin and the grinding wheel detecting pin; and the truer detecting pin and the grinding wheel detecting pin are provided such that tip ends of the truer detecting pin and the grinding wheel detecting pin are oriented radially outward with respect to the swivel center of the swivel table and are oriented in directions different from each other.

8. The truing device according to claim 7, wherein:

the grinding wheel detecting pin includes a grinding wheel end face detecting pin and a grinding wheel outer peripheral surface detecting pin;

the detector includes the grinding wheel end face detecting pin that detects contact with an end face of the grinding wheel, which is located at one side of the grinding wheel in a rotation axis of the grinding wheel, and the grinding wheel outer peripheral surface detecting pin that detects contact with an outermost peripheral surface of the grinding wheel, which is located at radially outermost side; and the sensor body fixedly holds the truer detecting pin, the grinding wheel end face detecting pin, and the grinding wheel outermost peripheral surface detecting pin.

9. The truing device according to claim 5, wherein:

the contact detecting member includes a columnar sensor;

the detector includes the columnar sensor formed in a columnar shape that extends in a direction along the swivel axis, and that detects contact with the object, at its outer peripheral surface; and the columnar sensor is rotated about the swivel axis relative to the truer to change a portion of the outer peripheral surface of the columnar sensor, the portion detecting contact with the truer, in a circumferential direction of the columnar sensor.

10. The truing device according to claim 9, wherein the columnar sensor is rotated about the swivel axis relative to the grinding wheel to change a portion of the outer peripheral surface of the columnar sensor, the portion detecting contact with the grinding wheel, in the circumferential direction of the columnar sensor.

11. The truing device according to claim 5, wherein:

the contact detecting member includes a columnar sensor;

the detector includes the columnar sensor formed in a columnar shape that extends in a direction along the swivel axis, and that detects contact with the object at its outer peripheral surface; and the columnar sensor is moved in a direction along the swivel axis relative to the truer to change a portion of the outer peripheral surface of the columnar sensor, the portion detecting contact with the truer, in an axial direction of the columnar sensor.

12. The truing device according to claim 11, wherein the columnar sensor is moved in the direction along the swivel axis relative to the grinding wheel to change a portion of the outer peripheral surface of the columnar sensor, the portion detecting contact with the grinding wheel, in the axial direction of the columnar sensor.

13. The truing device according to claim 1, further comprising:

a movable body that is provided on the swivel table, and that supports the truer such that the truer is movable in a radial direction of the swivel table.

14. The truing device according to claim 1, wherein:

the detector has a contact detecting member that detects contact with an object; and the detector detects contact with the truer with use of the contact detecting member, using the swivel center of the swivel table, as a reference position, to detect the distance from the truing edge position of the truer to the swivel center of the swivel table.

* * * * *